US011661690B2

(12) United States Patent
Adams et al.

(10) Patent No.: US 11,661,690 B2
(45) Date of Patent: May 30, 2023

(54) QUILT BINDING PRESS

(71) Applicants: Susan Lee Adams, St. George, UT (US); Michele Noble, West Jordan, UT (US); Nicholas Morgan Adams, Nashville, TN (US)

(72) Inventors: Susan Lee Adams, St. George, UT (US); Michele Noble, West Jordan, UT (US); Nicholas Morgan Adams, Nashville, TN (US)

( * ) Notice: Subject to any disclaimer, the term of this patent is extended or adjusted under 35 U.S.C. 154(b) by 25 days.

(21) Appl. No.: 17/361,794

(22) Filed: Jun. 29, 2021

(65) Prior Publication Data

US 2022/0002926 A1 Jan. 6, 2022

Related U.S. Application Data

(60) Provisional application No. 63/047,732, filed on Jul. 2, 2020.

(51) Int. Cl.

| | |
|---|---|
| ***D05B 29/00*** | (2006.01) |
| ***D06F 75/30*** | (2006.01) |
| ***D06F 75/38*** | (2006.01) |

(52) U.S. Cl.

CPC ..... *D05B 29/00* (2013.01); *D06F 75/30* (2013.01); *D06F 75/38* (2013.01)

(58) Field of Classification Search

CPC ..... D05B 29/00; D05B 35/06; D05B 11/00; D06F 75/30; D06F 75/38; D06F 75/40; D06F 79/00; D06F 79/02; D06F 85/00; D06F 89/00; D06F 71/40

See application file for complete search history.

(56) References Cited

U.S. PATENT DOCUMENTS

| | | | | | |
|---|---|---|---|---|---|
| 778,083 | A * | 12/1904 | Strauss | B65H 45/107 | 493/406 |
| 945,432 | A * | 1/1910 | Yost | B65H 45/22 | 493/476 |
| 1,001,443 | A * | 8/1911 | Rand et al. | B31B 50/26 | 493/406 |
| 1,537,118 | A * | 5/1925 | Kent | D06F 89/00 | 112/152 |
| 1,771,328 | A * | 7/1930 | Gabel | D06F 75/30 | 223/36 |
| 2,253,732 | A * | 8/1941 | Segelin et al. | A41D 1/10 | 12/146 D |
| 3,785,599 | A * | 1/1974 | Ramirez | D06F 79/02 | 248/117.2 |
| 3,793,754 | A * | 2/1974 | Harms | D06F 85/00 | 38/141 |
| 3,837,976 | A * | 9/1974 | Davidsson | A41H 31/00 | 156/577 |
| 5,590,821 | A * | 1/1997 | Reber | D06J 1/00 | 223/35 |
| D549,954 | S | 9/2007 | Jirak | | |
| 7,422,044 | B1 * | 9/2008 | Perez | B29C 63/0039 | 428/88 |

* cited by examiner

*Primary Examiner* — Ismael Izaguirre
(74) *Attorney, Agent, or Firm* — Harpman & Harpman

(57) ABSTRACT

A quilt binding press for folding and creasing a strip of binding fabric in a continuous engagement with a heated iron. The binding press has an iron engagement support platform with a pair of upstanding spaced parallel binding guides provides a folding and guide path for a strip of binding material be folded and pulled there across the support platform for engagement with a heated iron there between the guides in a continuous manner.

6 Claims, 5 Drawing Sheets

QUILT BINDING PRESS

This application claims the benefit of U.S. Provisional Application No. 63/047,732 filed on Jul. 2, 2020.

BACKGROUND OF THE INVENTION

1. Technical Field

The disclosure relates generally to the field of quilting. More particularly, the disclosure relates to the binding of the quilt which is the final step to finishing the quilt. Specifically, the disclosure relates to the use of a device comprising a platform for the positioning of a fabric or flat iron between two alignment guides and a component for pulling binding fabric through the said device for pressing a lengthwise crease in the strip of binding fabric prior to sewing it onto the outer edge of the quilt.

2. Description of Prior Art

Quilting is the process of stitching or sewing multiple layers of fabric together by hand or by machine. The stitching passes through all layers which usually includes a top fabric layer, a backing fabric layer and a batting or insulating material sandwiched between the top and backing layers. Finishing a quilt refers to the process of applying a strip of fabric called the binding around the edge of the quilt to bind the exposed layers together and produce a clean border. Prior to applying the binding to the quilt, the long strip of binding fabric is often folding in half lengthwise and pressed. Pressing a straight, lengthwise crease in a long strip of fabric by hand requires the fabric to be laid flat on an ironing board, folded in half, and held in place while pressing the crease. This press-as-you-fold process is repeated along the length of the binding in short sections that are limited by the ironing area and the reach of the person operating the iron. This process can be tedious, difficult to manage and often results in off-centered or double creases.

Another option to simplify the process of finishing and binding a quilt is to purchase pre-pressed bindings that are sold with a lengthwise crease. Several types of pre-pressed binding products are available from various retailers.

A commercial product called the Quilt Binding Express (catalog number JT-753, June Tailor, Inc.) attempts to simplify the process of finishing and binding a quilt. The Quilt Binding Express is an ironing cushion mounted to a plastic back with slits cut into one edge of the plastic plate. A folded strip of binding fabric is fed through one of the slits and onto the iron cushion and a crease is pressed using an iron. The Quilt Binding Express simply serves as a folding tool, but it does not permit continuous feeding of fabric across a stationary pressing surface of an iron. Other disadvantages of the Quilt Binding Express are that the fabric follows a non-linear pathway from the slit in the plastic across the ironing surface.

U.S. Patent D549,954 which discloses a design for a quilt binding tool having a flat rectangular piece of material with a plurality of transversely extending slots increasing size longitudinally over its surface for inserting and folding quilt binding.

SUMMARY OF THE INVENTION

A quilt binding press for imparting straight line folding creases in strips of binding fabric in a continuous pull through manner. The binding press has a platform with a pair of upstanding spaced parallel aligned guides providing a folding, binding fabric infeed, creased and pressed binding outfeed. The upstanding alignment guides define a positioning binding engagement area there between for a press iron to engage and press the crease into the now folding binding fabric as it is pulled there across.

DETAILED DESCRIPTION OF THE INVENTION

Figure 1:
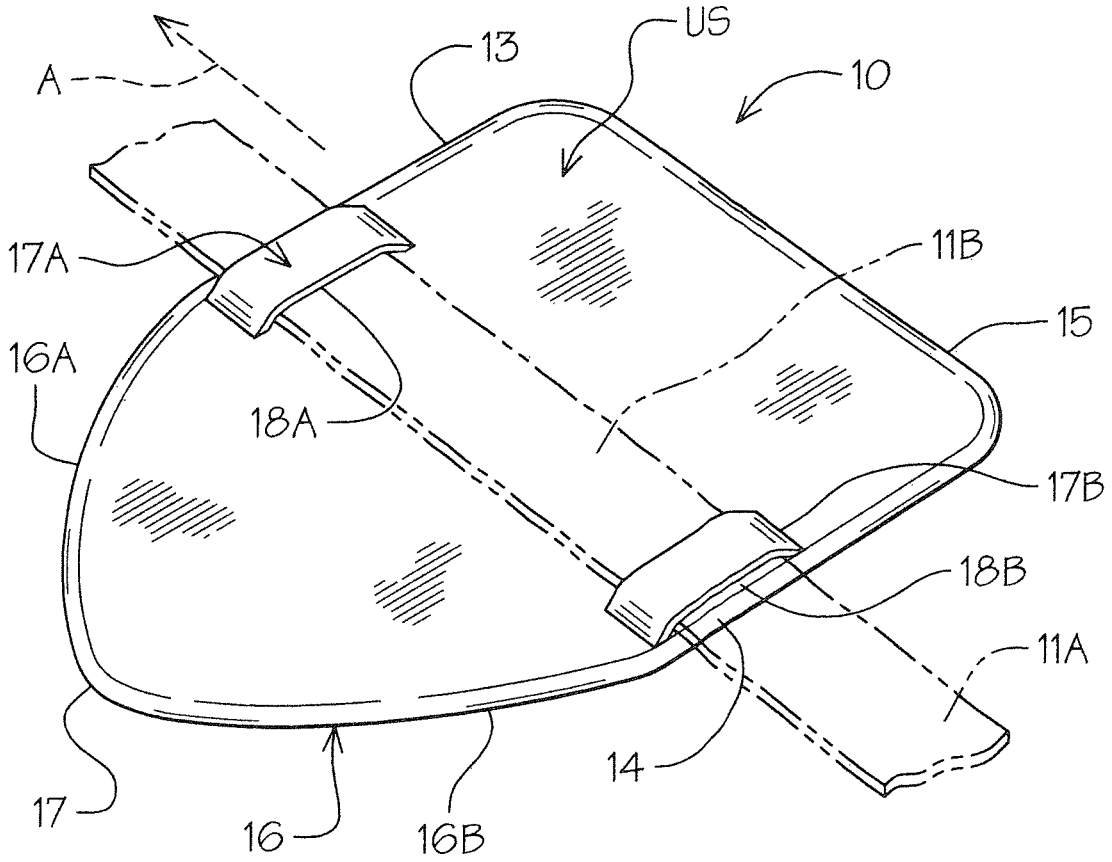
FIG. 1 is a perspective view of the quilt binding press of the invention.
Figure 2:
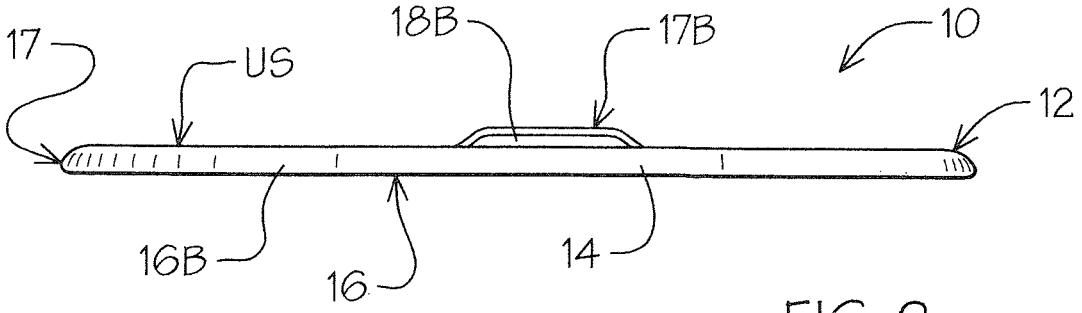
FIG. 2 is a side elevational view thereof.
Figure 3:
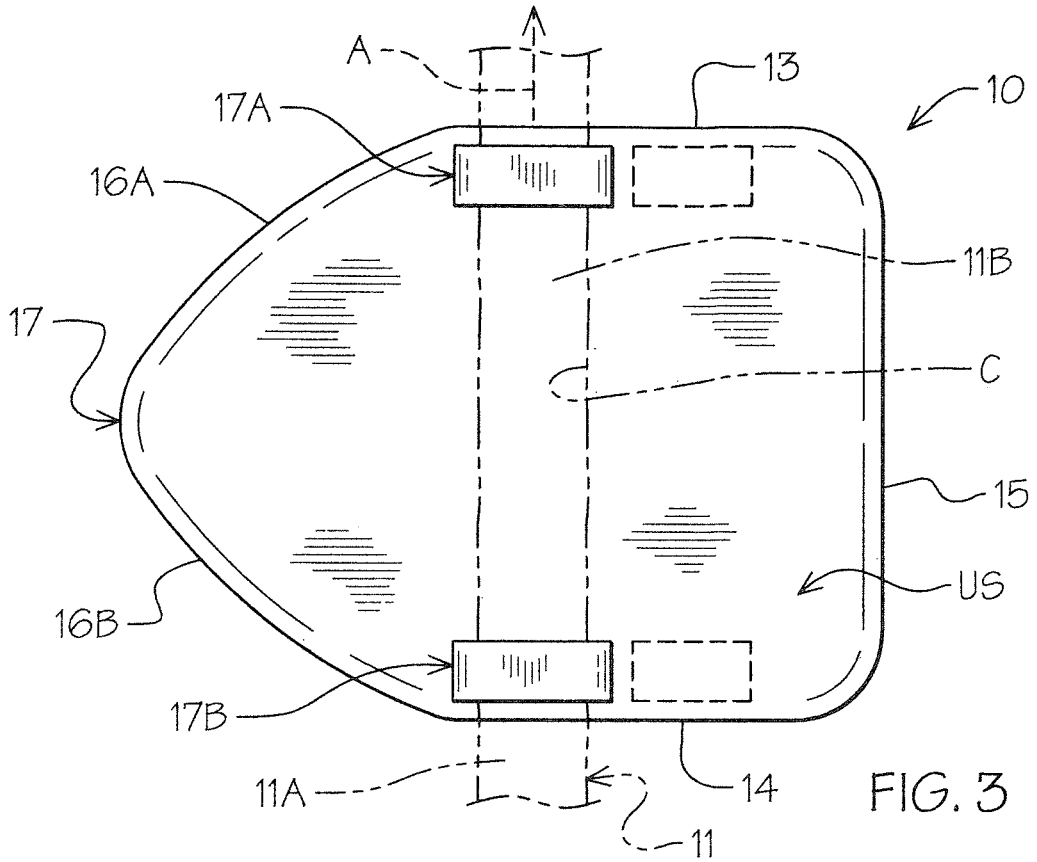
FIG. 3 is a top plan view thereof.
Figure 4:
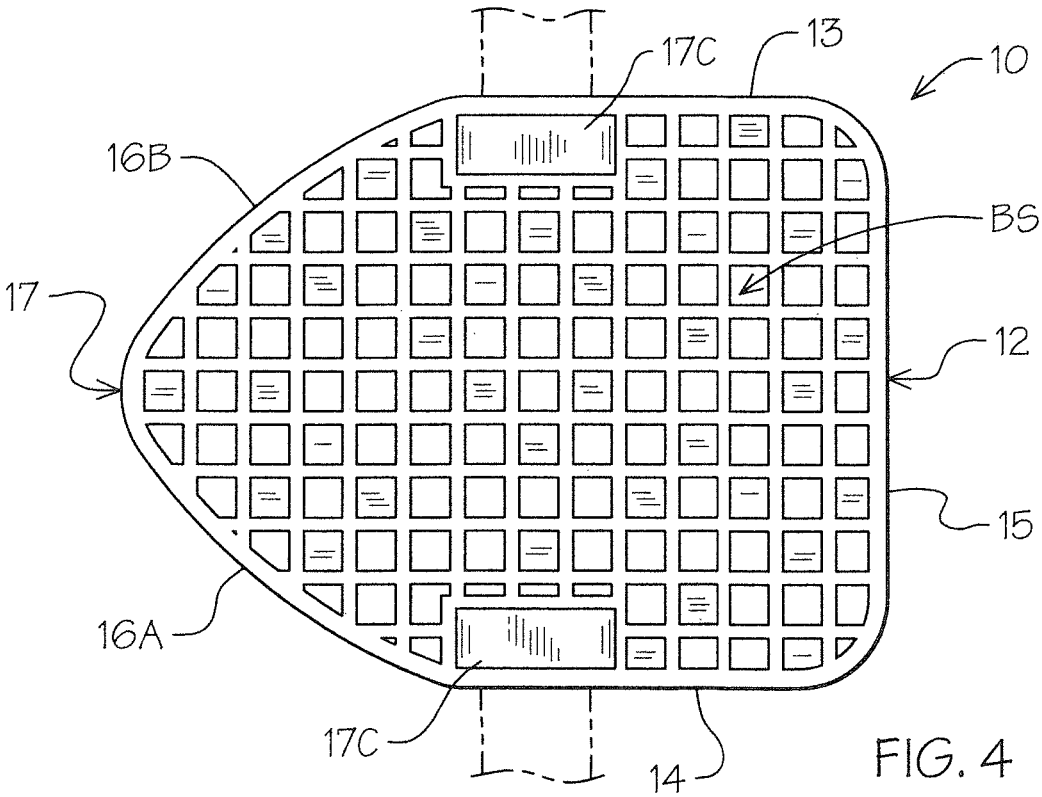
FIG. 4 is a bottom plan view thereof.
Figure 5:
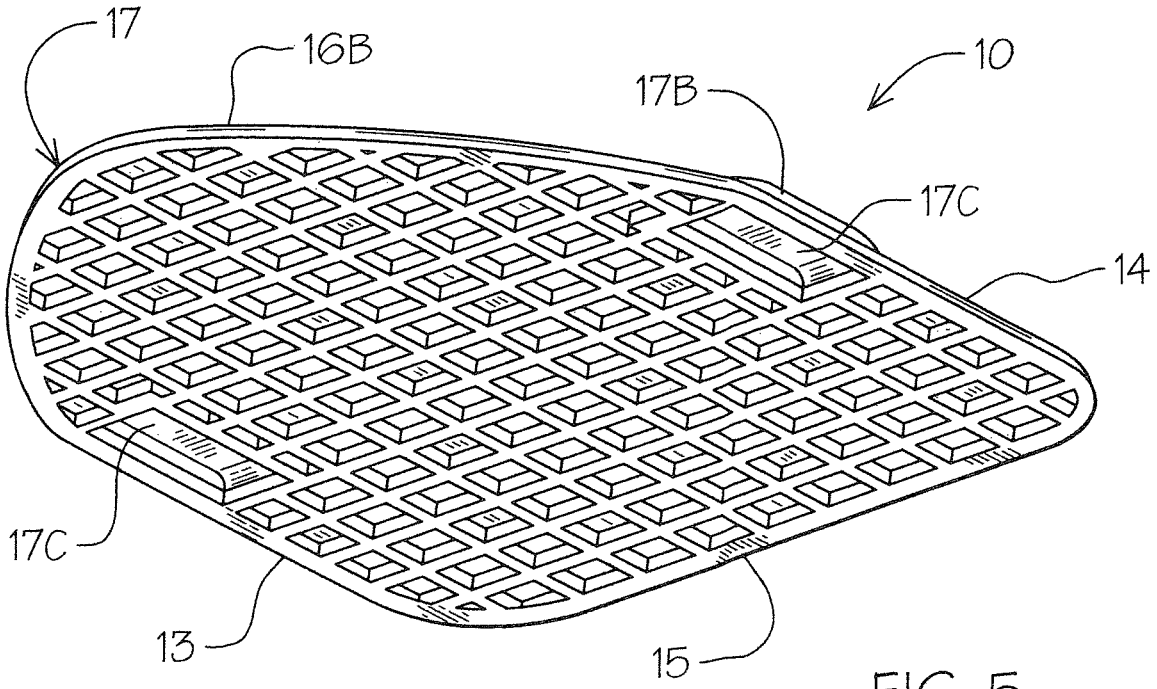
FIG. 5 is a perspective bottom view of the quilt binding press.

Referring to FIGS. 1-5 of the drawings, a quilt binding press 10 of the invention can be seen for folding and creasing strips of quilt binding fabric 11, shown in broken lines, having an iron engagement support platform 12 with oppositely disposed parallel side edges 13 and 14 interconnected at right angles to a rear edge 15. A contoured front-end edge 16 is defined by a pair of mirrored convex edge surfaces 16A and 16B extending to an intersection central point at 17. The platform 12 has a generally flat upper surface US with a pair of upstanding binder fabric guides 17A and 17B which extend inwardly along the respective spaced parallel side edges 13 and 14 in spaced relation to the rear edge 15 and to the transition of the respective contoured front edge surfaces 16A and 16B as best seen in FIGS. 1, 2 and 3 of the drawings. The platform 12 has a waffle shaped bottom surface BS with corresponding large recess 17C for the fabric guides 17A and 17B as best seen in FIG. 5 of the drawings. This aids in platform heat dissipation.

Figure 6:
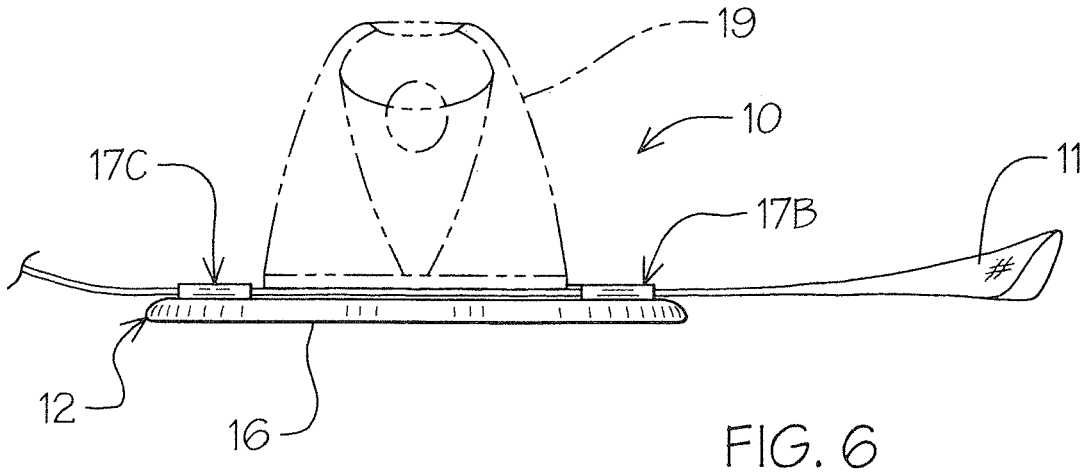
FIG. 6 is an end elevational view of the quilt binding press in use with a pressing iron shown in broken lines.

The elongated upstanding fabric guides 17A and 17B define a pair of translateral restrictive passageways 18A and 18B between the engagement platform 12 which will, by definition, fold flat strips of binding fabric 11A over upon itself longitudinally as it passes therethrough illustrated best in FIGS. 5 and 6 of the drawings. It will be apparent that the longitudinal dimension of the respective fabric guides 17A and 17B openings 18A and 18B will be equal to the folded binding strips 11B transverse fold dimension and that the fabric guides 17A and 17B are therefore in spaced parallel alignment to provide a direct linear engagement path as required for quilting fabric binding strip 11 as they are folded and pressed there between.

The ironing platform 12 and the upstanding binding fabric guides 17A and 17B are made of heat resistant material such as synthetic polymers as silicone or other suitable formable material such as, but not limited to fabric, glass or metal as will be understood by those skilled in the art. The engagement support platform 12 and guides must be able to withstand an application temperature range of between 50- and 500-degrees Fahrenheit.

Figure 7:
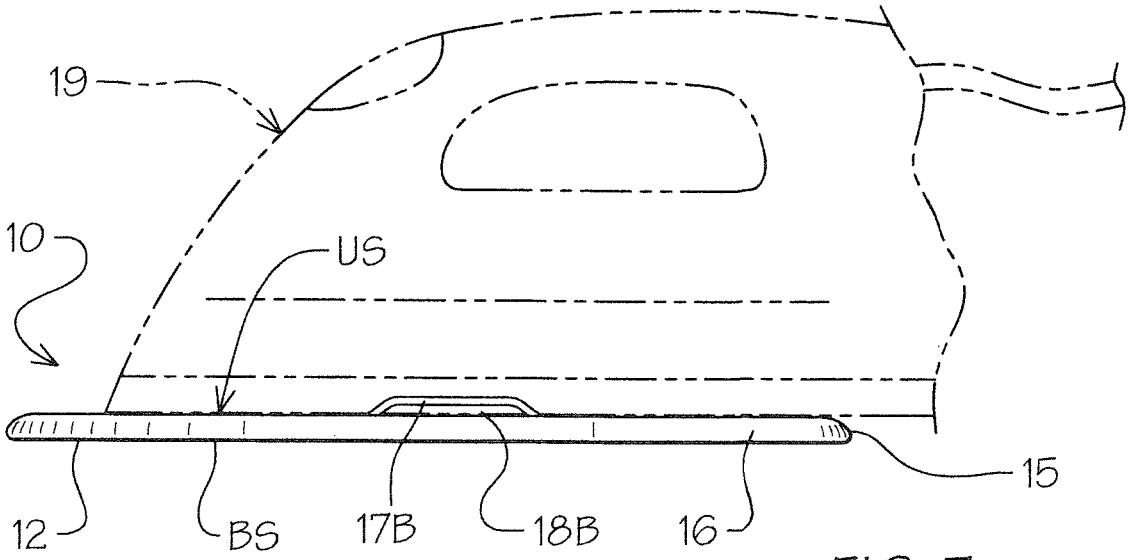
FIG. 7 is a side elevational view thereof.
Figure 8:
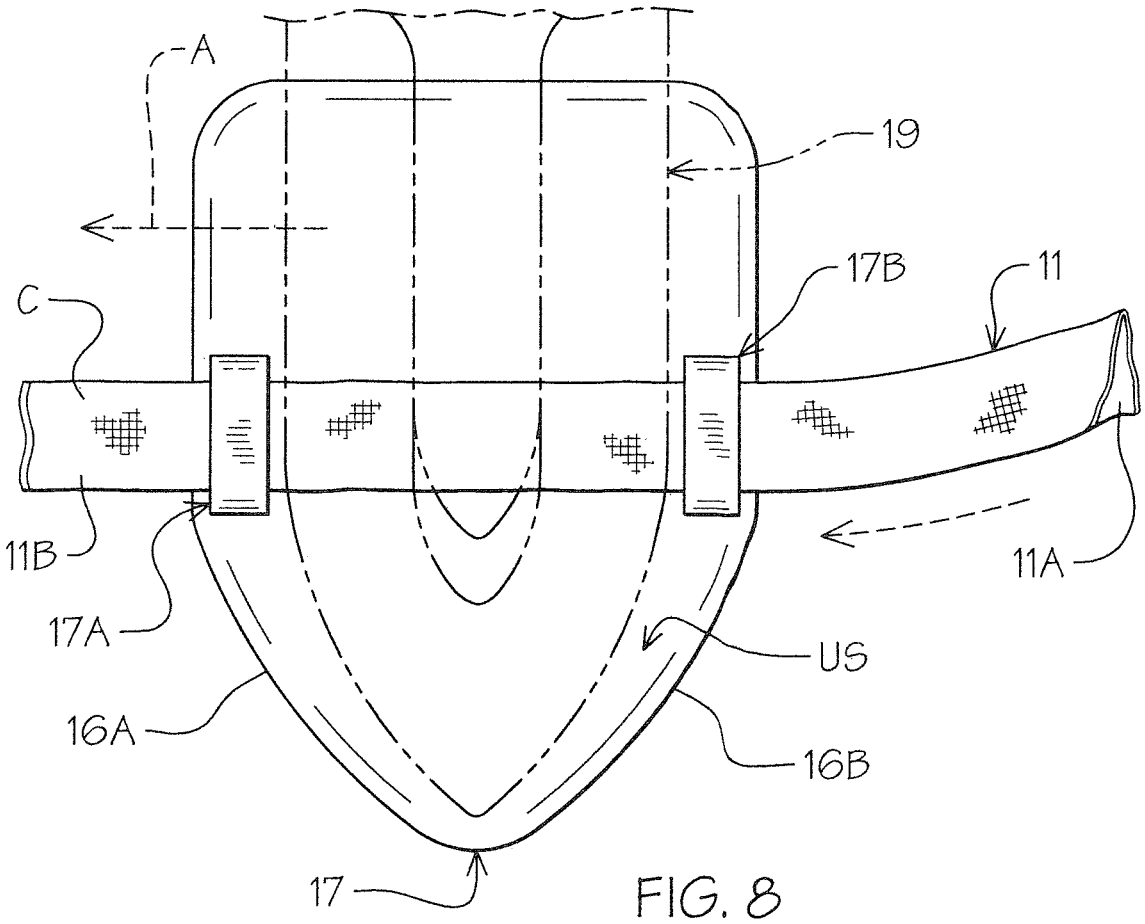
FIG. 8 is a top plan graphic representation of the quilt binding press in use with a pressing iron shown in broken lines.

In use, the application requires the use of an iron 19 illustrated in broken lines in FIGS. 6-8 of the drawings which is to be positioned on the upper surface US of the support platform 12 between the respective binder fabric guides 17A and 17B and directly on the folded binder fabric 11B as it is passed between the guides 17A and 17B. An iron 19 engages and heats the folded binding fabric 11B as it is pulled through the guides 17A and 17B indicated by directional arrow A thereby creasing C the fabric strip as required in a continuous manner. The fabric guides 17A and 17B therefore provide provisional placement for the iron 19 there between assuring ease of use. The folded fabric binding 11B will therefore slide across the upper surface US of the platform 12, as noted, in a linear pathway defined by the effective engagement through the fabric guides 17A and 17B. The above referred to process continues until the length of binding fabric 11 has been pulled through the device. The iron 19 remains stationary for the duration of this process with no user manipulation except to adjust its position as needed. Once the full length of the binding fabric 11 has passed through, the iron 19 is removed from the support platform 12.

It will be apparent from the above referred to description that alternate pairs of fabric guides 20 may be added, shown in broken lines in FIG. 3 of the drawings, and that the addition of such alternate fabric guides 20 may be of different longitudinal lengths thereby defining alignment passageways of varying dimensions to accommodate different sizes of quilt binding available in the marketplace.

Figure 9:
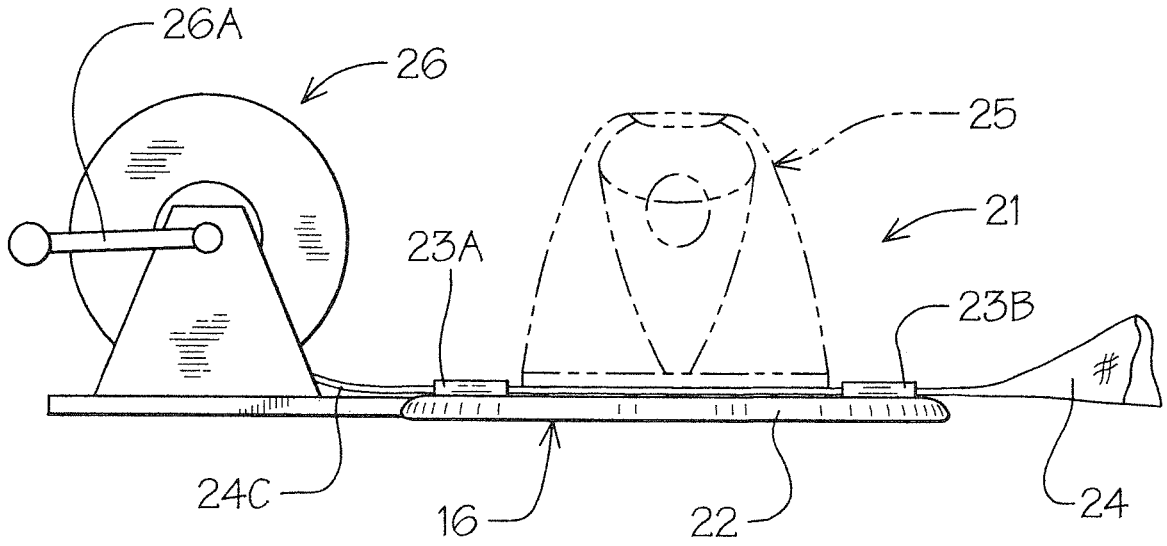
FIG. 9 is a front elevational view of an alternate form of the invention.

Referring now to FIG. 9 of the drawings, a first alternate binding press 21 can be seen having a contoured binding engagement platform 22, a pair of spaced parallel upstanding binding guides 23A and 23B, each with an access translateral opening for receiving a strip of quilting binding fabric 24 thereby folding it longitudinally at 24A for pressing engagement with an iron 25. In this form of the invention a transport take up spool assembly 26 is positioned adjacent the effective outflow guide 23A with a crank handle 26A which will pull and collect the processed quilt binding 24C and thereby provide transverse transport across the iron engagement platform 22 continuous engagement with the iron 25.

This process continues until the length of binding fabric has been pulled through the binding press 21. The iron 25 remains stationary for the duration of this process with no user manipulation except to adjust the position as needed. Once the full length of binding fabric 24 has passed through the binding press 21, the binding fabric 24C on a binding fabric spool 26A is removed and the iron 25 is moved from the iron platform 22.

Figure 10:
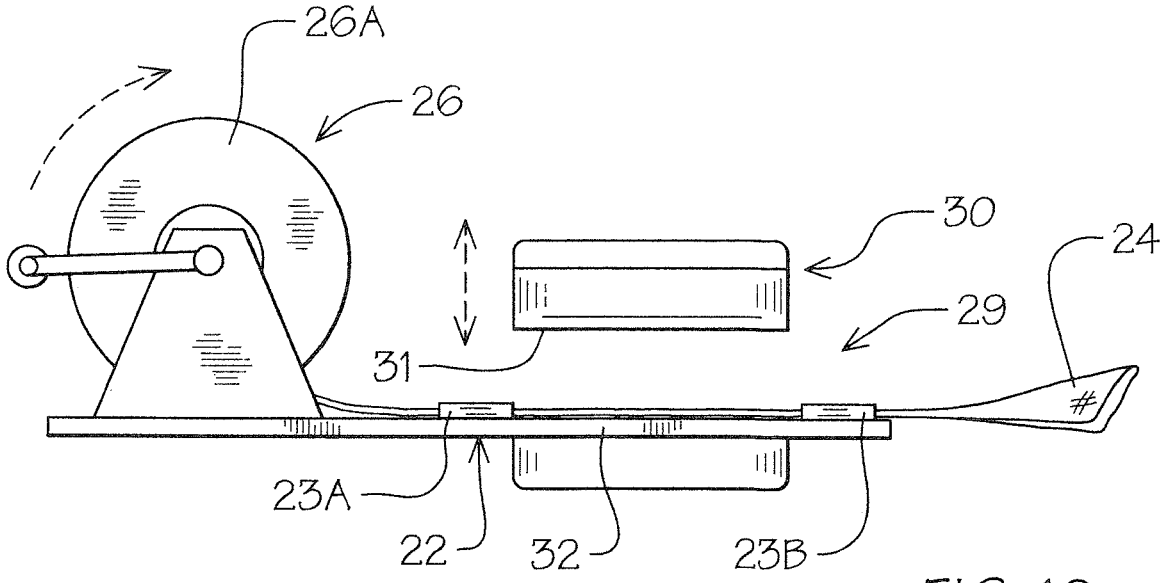
FIG. 10 is a front elevational view of a second alternate form of the invention.

Referring now to FIG. 10 of the drawings, a second alternate binding press 26 of the invention can be seen wherein as an essentially duplicated binding press 21 except that the independent iron 25 is replaced with an integrated flat iron assembly 30 which is positioned between previously described upstanding binding guides 23A and 23B wherein the flat iron assembly 30 comprises a movable heated top plate 31 and heated or non-heated fixed bottom plate 32 of the engagement platform 22. This augmented system of an integrated heating plate system provides for selective continuous engagement of the folded quilting band 24A as it passes between the respective fabric guides 23A and 23B and is taken up by the hereinbefore described transport take up spool 26A of the spool assembly 26.

It will be evident to those skilled in the art that various crank adaptations of the spool configuration are available and well within the scope of the invention.

It will thus be seen that a new and novel ironing press for quilt binding has been illustrated and described and as noted it will be apparent to those skilled in the art that various changes and modification may be made therein without departing from the spirit of the invention. Therefore I claim:

The invention claimed is:

1. A quilt binding press for folding and creasing a quilt binding strip comprises, a support engagement platform, at least one pair of elongated upstanding binding guides positioned thereon, said binding guides in spaced parallel relation to one another, each of said binding guides defining a binding passage engagement opening in alignment to one another for folding said quilt binding strip upon itself and positioning the folded quilt binding strip between said binding guides for engagement with an iron on said engagement platform between said independent binding guides.

2. The quilt binding press set forth in claim 1 wherein said support engagement platform has spaced parallel side edges, an interconnecting rear edge in spaced relation to said binding guides, and a front edge in spaced relation to said binding guides, each of said upstanding binding guides comprise, a guide of a longitudinal dimension equal to the transverse dimension of said folded quilt binding strip.

3. The quilt binding press set forth in claim 1 wherein said binding press further comprises a folded press binding transport take up spool in alignment with one of said binding guides.

4. The quilt binding press set forth in claim 3 wherein said transport take up spool comprises, a reel and a reel handle for rotation of said reel.

5. A quilt binding press for folding and creasing a quilt binding strip comprises, a support engagement platform, a pair of elongated upstanding binding guides positioned thereon, said binding guides in spaced parallel relation to one another, said binding guides define binding pass-through engagement openings for folding said quilt binding strip and positioning the quilt binding strip there between, a flat iron assembly positioned on said support engagement platform comprising a fixed iron surface and a movable oppositely disposed heated iron surface for selective engagement of a folded quilt binding passing there between.

6. The quilt binding press set forth in claim 1 wherein the support engagement platform bottom surface has a plurality of aligned spaced recesses therein and a pair of enlarged recesses to define the respective upstanding fabric guides.

* * * * *